US007627917B2

(12) United States Patent
Vandenbelt

(10) Patent No.: US 7,627,917 B2
(45) Date of Patent: Dec. 8, 2009

(54) SOUND PILLOW

(75) Inventor: Rudy A. Vandenbelt, Ottawa (CA)

(73) Assignee: Headwaters R&D, Inc., Ottawa (CA)

( * ) Notice: Subject to any disclaimer, the term of this patent is extended or adjusted under 35 U.S.C. 154(b) by 0 days.

(21) Appl. No.: 11/867,085

(22) Filed: Oct. 4, 2007

(65) Prior Publication Data

US 2009/0089931 A1 Apr. 9, 2009

(51) Int. Cl.
*A47G 9/00* (2006.01)

(52) U.S. Cl. ..... 5/639; 5/636; 5/904

(58) Field of Classification Search ..... 5/636, 5/639, 630, 904

See application file for complete search history.

(56) References Cited

U.S. PATENT DOCUMENTS 4,862,438 A * 8/1989 Fry ..... 369/19
6,668,400 B1 * 12/2003 Nichols et al. ..... 5/485

* cited by examiner

*Primary Examiner*—Fredrick Conley
(74) *Attorney, Agent, or Firm*—Albert Peter Durigon

(57) ABSTRACT

The sound pillow is sanitary and does not need to be discarded and replaced if it becomes soiled from use or accident, because it is constructed to be machine washable, and, among other things, it privately delivers good quality stereo audio for rest, learning, enjoyment or other purposes while being as easy and convenient to use as conventional bed pillows of standard size. The sanitary and easy to use sound pillow includes a speaker receiving pocket nested inside and open to a pillow casing and stereo speakers removably insertable into the speaker receiving pocket.

4 Claims, 1 Drawing Sheet

60

20
30
40
50
70
10

SOUND PILLOW

FIELD OF THE INVENTION

This invention is drawn to the field of head supports, and more particularly, to a novel sound pillow.

BACKGROUND OF THE INVENTION

Speaker embedded pillows of mini- and standard-size are known alternatives to headphones or earphones for privately delivering recorded music, sound therapy or other audio content to individual listeners without disturbing the rest or enjoyment of others. In such devices, whether of mini- or standard-size, the speaker's volume may be adjusted independently of the sound source's volume; different plug ends may be provided to accommodate MP3 players, PCs, or other analog or digital sound sources; and different length speaker cords may be provided to accommodate different use situations.

Typically, the heretofore known speaker embedded pillows of King, Queen or other well-known standard sizes employed for bed pillows are permanently fitted during manufacture with one or more nonremovable speakers. The speakers are usually wired for stereo but a single speaker system may be employed. Although they offer the ease and convenience of use of regular, standard-sized pillows, the nonremovable speakers prevent washing with the result that the heretofore known speaker embedded pillows need to be retired from service once they become soiled or otherwise are rendered unsanitary, for example, by dust mites.

The heretofore known mini-sized speaker embedded pillows may be used with any standard-sized King, Queen or double/single pillow, by placing it above or below the same, and/or may be used as a standalone mini-pillow, in a seat of a plane, for example, or train or other vehicle, or home or office chair or sofa. However, when used together with pillows of standard size, it may be inconvenient at times to have to move both the mini- and standard-sized pillows when changing places, for example, from sofa to bed, and it may be disconcerting, or even interrupt sleep or rest, whenever the relative position between the mini- and standard-sized pillows is inadvertently changed, such as, for example, when changing positions in bed or seat during the normal tossing and turning of a session of sleep or rest, undesirably requiring their conscious or semiconscious but in any event manual repositioning in order to restore proper alignment so as to resume listening.

There is thus the need for a sound pillow having all the advantages of the heretofore known sound pillows but with none of their attendant disadvantages.

SUMMARY OF THE INVENTION

Accordingly, it is one object of the present invention to disclose a sound pillow of King, Queen or of the other well-known standard sizes employed for bed pillows that may be washed to remove dirt and dust mites without damaging its electrical circuitry.

It is another object of the present invention to disclose a sanitary sound pillow of King, Queen or of the other well-known standard sizes employed for bed pillows that is as easy to use as a conventional pillow of standard size that eliminates the inconvenience of having to carry multiple mini- and standard-sized pillows during change of location as well as eliminates the inconvenience and annoyance of having to realign sound and pillow elements resulting from change of their relative position.

It is another object of the present invention to provide a sanitary, easy to use sound pillow that is manufacturable at comparatively low materials and labor costs.

In accordance with these and other objects, the sanitary and easy to use sound pillow of the present invention includes a pillow casing of King, Queen or of the other well-known standard sizes employed for bed pillows enclosing a first pocket that is stuffed to serve as a cushion for the head during sleep or rest. A speaker casing is attached to the pillow casing enclosing a second pocket inside said first pocket into which and from which a sound source may be inserted and removed into and out of the pillow casing. A sound source is provided that is adapted to be insertable in and removable from the second pocket. Means are disclosed for maintaining the sound source in predetermined position in the second pocket when inserted into the second pocket and allowing removal of the sound source from its predetermined position in the second pocket. When in inserted condition, the speakers of the sound pillow of the present invention thereby deliver private audio for individual listening but when in removed condition the sound pillow of the present invention may readily be washed.

In the preferred embodiment, the pillow casing preferably includes superimposed fabric sheets threadably attached peripherally about aligned edges. The speaker casing preferably includes a generally cylindrical fabric sleeve threadably attached to opposing edges of the pillow casing such that the sleeve is open at least one, and preferably both, of the opposing edges of the pillow casing. The sound source preferably includes left and right low-profile stereo speakers. The speaker position maintaining and removal allowing means preferably includes separable fasteners positioned along the second pocket of the sleeve of the speaker casing in position to provide gated access at least one, and preferably both, open sleeve ends and predetermined positioning of the left and right stereo speakers determined to provide good stereo separation of the left and right stereo speakers within the speaker sleeve interior to the pillow casing.

BRIEF DESCRIPTION OF THE DRAWINGS

These and other objects, advantageous features and inventive aspects of the present invention will become apparent as the invention becomes better understood by referring to the following detailed description of the presently preferred embodiments, and to the drawings, wherein.

DETAILED DESCRIPTION OF THE PRESENTLY PREFERRED EMBODIMENTS

Figures 1, 2, 3, 4:
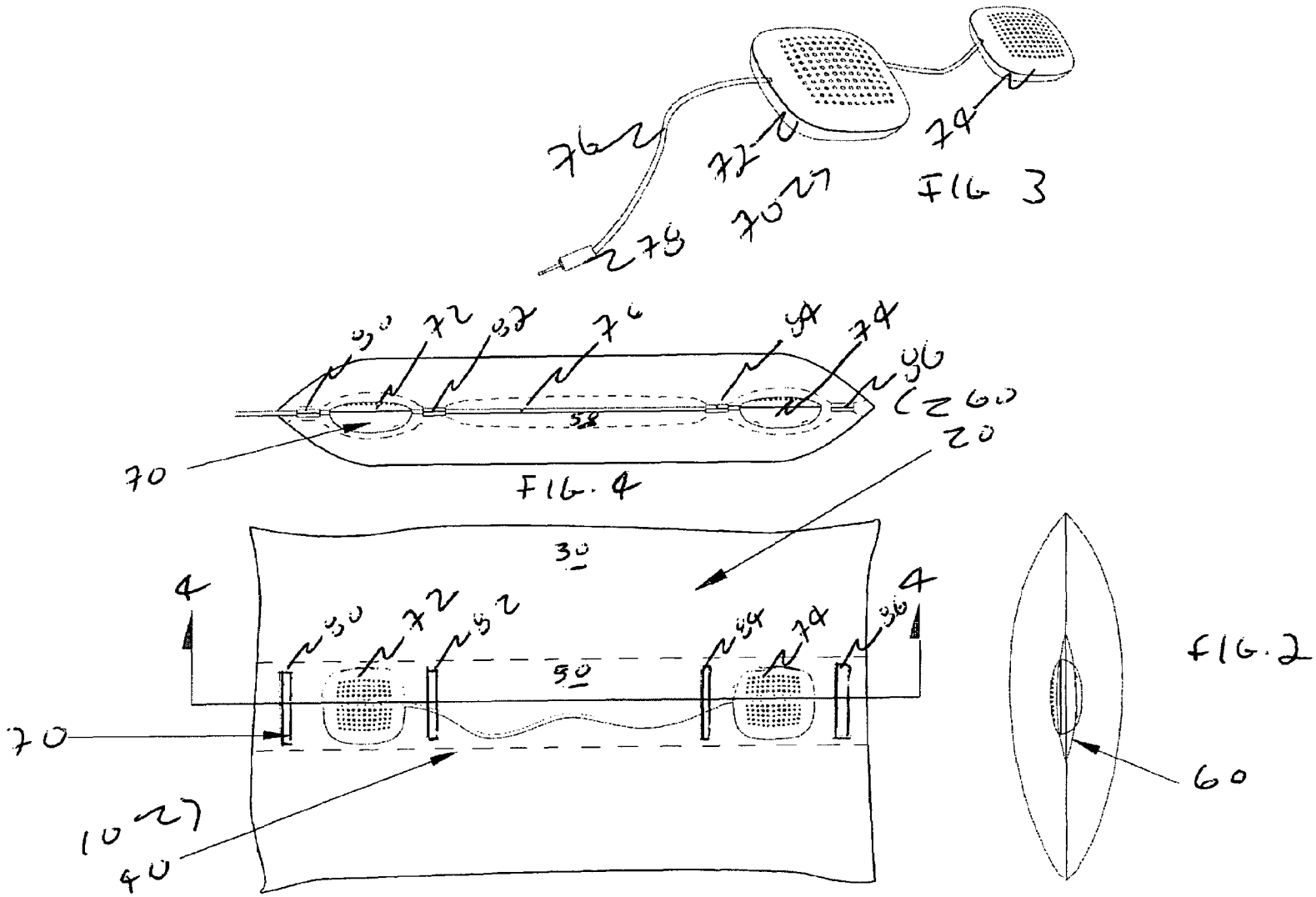
FIG. 1 is a partially pictorial, partially schematic top plan view of the novel sound pillow of the present invention.
FIG. 2 is a partially pictorial, partially schematic end view of the sound pillow of the present invention.
FIG. 3 is a pictorial view of the pillow speakers thereof.
FIG. 4 is a partially pictorial, partially schematic side sectional view along the lines 4-4 of FIG. 1.

With reference to the drawings, the sound pillow of the present invention will now be described. As appears more fully herein, the sound pillow is sanitary and does not need to be discarded and replaced if it becomes soiled from use or accident, because it is constructed to be machine washable, and, among other things, it privately delivers good quality stereo audio for rest, learning, enjoyment or other purposes while being as easy and convenient to use as conventional bed pillows of standard size.

Referring now to FIG. 1, generally designated at 10 is a partially pictorial, partially schematic top plan view of one exemplary and presently preferred embodiment of the novel sound pillow in accord with the present invention. The sound pillow 10 includes a fabric casing 20 defining an interior compartment generally designated 30 that is stuffed with material to serve as a cushion for the head, preferably a washable filler material such as polyester fiber, not shown. The casing 20 of the sound pillow 10 is preferably King, Queen or of the other well-known standard sizes employed for bed pillows. Any filler material other than the presently preferred washable polyester fiber may be employed to serve as the cushioning material.

A fabric tube schematically illustrated in dashed outline generally designated 40 is threadably attached to the casing 20 to provide a passageway 50 inside the interior compartment 30. The passageway 50 terminates to each side of the sound pillow 10 in speaker insertion and removal portals generally designated 60 as best seen in FIG. 2. The portals 60 provide openings through which speakers generally designated 70 may be inserted into and removed from the passageway 50 interior to the compartment 30 of the casing 20 of the sound pillow 10. Although a fabric tube open at and attached to each of the pillow's sides providing a passageway interior to the casing is presently preferred, any suitable means selectably providing speaker insertion for use inside the pillow casing and speaker removal to allow washing or for other purposes may be employed.

The speakers 70 as best seen in FIG. 3 preferably include left and right low-profile stereo speakers 72, 74 and an electrical cable 76 connecting the left and right stereo speakers 72, 74 terminating in a plug end 78. While left and right stereo speakers 72, 74 are preferred, a different number of speakers, such as a mono speaker, could be employed. Any suitable plug end 78 may be employed, such as for use with an MP3 player, stereo system, or that is adapted for use with any other analog or digital sound source.

As best seen in FIG. 4, separable fasteners 80, 82, and 84, 86, are provided at predetermined positions along the passageway 50; the separable fasteners 80, 82 provide a left compartment that holds the left speaker 72 in predetermined position inside the passageway 50 and the separable fasteners 84, 86 provide a right compartment that holds the right speaker 74 in predetermined position inside the passageway 50. The predetermined positions of the left and right compartments provided by the separable fasteners 80, 82 and 84, 86 are determined to provide good spatial stereo sound separation and stereo sound quality from the left and right speakers 72, 74.

Although separable fasteners threadably attached in predetermined positions inside a passageway of a fabric tube are presently preferred, any suitable means for providing predetermined speaker positioning determined to maximize sound delivery and quality when the sound system is inserted in the sound pillow and allows its removal may be employed.

As will be readily appreciated, the sound pillow 10 of the present invention is as easy to use in-place and may be carried place-to-place with the same convenience as conventional bed pillows of any standard size, and when not in use to privately deliver good quality audio, the stereo speakers may be removed and the pillow casing washed.

The sanitary and easy to use sound pillow 10 is manufacturable at comparatively low materials and labor costs. Preferably in a first step, overlaid sheets of fabric or other flexible casing material are so threadably attached and manipulated as to provide a pillow casing having captured interior seams enclosing an interior compartment communicating with opposing, open side vents. In a further step, separable fasteners are threadably attached to a sheet of fabric or other flexible material in position to provide left and right speaker compartments and the sheet of fabric is so closed on and threadably attached to itself as to provide a fabric tube having open ends. The open ends of the fabric tube in a next step are threadably attached to the open side vents of the pillow casing so as to provide a passageway extending between open side portals. In another step, polyester fill is stuffed into the interior compartment of the pillow casing. In the next and final step, the separable fasteners are opened, left and right stereo speakers are inserted through one side portal into the passageway and slid into their intended positions, and the separable fasteners are closed to removably retain the speakers within the left and right compartments of the sound pillow.

Many modifications of the present invention will become apparent to those of skill in the art without departing from the scope of the appended claims. For example, only one portal at one side edge may be provided, or the portal may open at a place other than along the casing's side edges, or a different speaker insertion method or means other than a fabric tube may be employed to provide speaker insertion and removal, a sound source other than stereo speakers could be used and/or a different arrangement of separable fasteners may be employed.

What is claimed is:

1. A sanitary and easy to use sound pillow, comprising:

a pillow casing of preselected size selected from standard King, Queen and single/double pillow sizes having opposing sides and an inside;

a speaker system;

first means coupled to the pillow casing for selectably providing speaker system insertion into and speaker system removal from said pillow casing, said first means including fabric walls inside the pillow casing providing a hollow tubular pocket having an outside and inside and extending substantially between said opposing sides of the pillow casing and opening at at least one of said opposing sides of the pillow casing providing a passageway inside said hollow tubular pocket into which said speaker system is removably received through said opening at at least one of said opposing sides of the pillow casing and providing an annulus between the outside of the hollow tubular pocket and inside of the pillow casing in which annulus machine washable material is contained to serve as a cushion for the head; and second means cooperative with said first means for providing predetermined speaker positioning inside said passageway of said hollow tubular pocket determined to maximize sound delivery and quality when said speaker system is inserted inside said passageway of said hollow tubular pocket provided by said fabric walls inside the pillow casing.

2. The sanitary and easy to use sound pillow of claim 1, wherein said hollow tubular pocket extends between both said opposing sides of said pillow casing and is open at both the opposing sides of said pillow casing.

3. The sanitary and easy to use sound pillow of claim 1, wherein said speaker system includes left and right low-profile stereo speakers, and wherein said second means includes separable fasteners threadably attached to said inside of said hollow tubular pocket to provide left and right compartments in predetermined positions along said passageway determined to provide good spatial stereo separation and quality stereo sound from said left and right low-profile stereo speakers whenever they are respectively received in said left and right compartments.

4. The sanitary and easy to use sound pillow of claim 3, wherein said second means includes first and second separable fasteners provided on the inside of the fabric walls in spaced apart relation along the passageway of the hollow tubular pocket to provide said first compartment in the passageway proximate to one of said opposing sides of said pillow casing and includes third and fourth separable fasteners provided on the inside of the fabric walls in spaced apart relation along the passageway of the hollow tubular pocket to provide said second compartment in the passageway proximate to the other one of said opposing sides of said pillow casing.

* * * * *